US009746174B2

(12) United States Patent
Wilhelm et al.

(10) Patent No.: US 9,746,174 B2
(45) Date of Patent: Aug. 29, 2017

(54) FLOW CONTROL DEVICES AND METHODS FOR A ONCE-THROUGH HORIZONTAL EVAPORATOR

(71) Applicant: Alstom Technolgy Ltd., Braden (CH)

(72) Inventors: Bruce W. Wilhelm, Enfield, CT (US); Wei D. Zhang, South Windsor, CT (US); Jeffrey F. Magee, Longmeadow, MA (US); Vinh Q. Truong, Southington, CT (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 624 days.

(21) Appl. No.: 13/744,121

(22) Filed: Jan. 17, 2013

(65) Prior Publication Data

US 2013/0180474 A1 Jul. 18, 2013

Related U.S. Application Data

(60) Provisional application No. 61/587,332, filed on Jan. 17, 2012, provisional application No. 61/587,428, filed on Jan. 17, 2012, provisional application No. 61/587,359, filed on Jan. 17, 2012, provisional application No. 61/587,402, filed on Jan. 17, 2012.

(51) Int. Cl.
*F22B 29/06* (2006.01)
*F22D 5/34* (2006.01)
(Continued)

(52) U.S. Cl.
CPC ..... *F22B 29/06* (2013.01); *F22B 15/00* (2013.01); *F22D 5/34* (2013.01); *F28D 7/082* (2013.01);
(Continued)

(58) Field of Classification Search
CPC ..... F22B 29/06; F22B 29/062; F22B 35/00; F22B 1/1815; F22D 1/02; F22D 5/00; F22D 5/34
(Continued)

(56) References Cited

U.S. PATENT DOCUMENTS 343,258 A 6/1886 Smith
459,998 A 9/1891 Davis
(Continued)

FOREIGN PATENT DOCUMENTS

CH 144501 A 12/1930
CN 2420739 Y 2/2001
(Continued)

OTHER PUBLICATIONS

PCT Search Report and Written Opinion issued in connection with Related PCT Application No. PCT/US2013/021962 on Sep. 12, 2013.
(Continued)

*Primary Examiner* — Steven B McAllister
*Assistant Examiner* — Ko-Wei Lin
(74) *Attorney, Agent, or Firm* — GE Global Patent Operation; Stephen G. Midgley

(57) ABSTRACT

Disclosed herein is a once-through evaporator comprising an inlet manifold; one or more inlet headers in fluid communication with the inlet manifold; one or more tube stacks, where each tube stack comprises one or more substantially horizontal evaporator tubes; the one or more tube stacks being in fluid communication with the one or more inlet headers; one or more outlet headers in fluid communication with one or more tube stacks; an outlet manifold in fluid communication with the one or more outlet headers; and a plurality of flow control devices to dynamically control the fluid flow to a respective inlet header.

11 Claims, 14 Drawing Sheets

(51) Int. Cl.

| | |
|---|---|
| ***F28F 1/00*** | (2006.01) |
| ***F28F 9/013*** | (2006.01) |
| ***F28F 9/22*** | (2006.01) |
| ***F28F 9/26*** | (2006.01) |
| ***F28D 7/08*** | (2006.01) |
| ***F22B 15/00*** | (2006.01) |
| ***F28F 9/02*** | (2006.01) |

(52) U.S. Cl.
CPC ..... *F28F 1/00* (2013.01); *F28F 9/013* (2013.01); *F28F 9/0275* (2013.01); *F28F 9/22* (2013.01); *F28F 9/26* (2013.01); *Y10T 137/0324* (2015.04)

(58) Field of Classification Search
USPC ..... 122/1 B, 406.1, 406.4, 448.4, 451 S
See application file for complete search history.

(56) References Cited

U.S. PATENT DOCUMENTS

| | | | | |
|---|---|---|---|---|
| 505,735 | A | 9/1893 | Vanes | |
| 1,256,220 | A | 2/1918 | Fulton | |
| 1,521,864 | A | 1/1925 | Broido | |
| 1,569,050 | A | 1/1926 | Swartz, Jr. | |
| 1,764,981 | A | 6/1930 | Rehfuss | |
| 1,814,447 | A | 7/1931 | Jones | |
| 1,827,946 | A | 10/1931 | Mayr | |
| 1,884,778 | A | 10/1932 | Lucke et al. | |
| 1,895,220 | A | 1/1933 | Grebe | |
| 1,924,850 | A | 8/1933 | Freiday | |
| 1,965,427 | A | 7/1934 | Nerad | |
| 2,800,887 | A | 7/1957 | Profos | |
| 2,847,192 | A | 8/1958 | Smith et al. | |
| 3,004,529 | A | 10/1961 | Argersinger et al. | |
| 3,368,534 | A | 2/1968 | Gorzegno et al. | |
| 3,447,602 | A | 6/1969 | Dalin | |
| 3,789,806 | A | 2/1974 | Gorzegno | |
| 3,854,455 | A | 12/1974 | Carson et al. | |
| 3,896,874 | A | 7/1975 | Bongaards et al. | |
| 4,246,872 | A | 1/1981 | Skinner et al. | |
| 4,290,389 | A | 9/1981 | Palchik | |
| 4,331,105 | A | 5/1982 | Kawamura et al. | |
| 4,336,642 | A | 6/1982 | Engelberts | |
| 4,532,985 | A | 8/1985 | Cutler | |
| 4,638,857 | A | 1/1987 | Fournier | |
| 4,676,305 | A | 6/1987 | Doty | |
| 4,915,062 | A | 4/1990 | Dolezal | |
| 4,976,310 | A | 12/1990 | Jabs | |
| 5,097,819 | A | 3/1992 | Talbert et al. | |
| 5,265,129 | A | 11/1993 | Brooks et al. | |
| 5,293,842 | A * | 3/1994 | Loesel | F22D 1/003 122/1 C |
| 5,366,452 | A | 11/1994 | Widlund et al. | |
| 5,398,644 | A | 3/1995 | Nilsson et al. | |
| 5,412,936 | A | 5/1995 | Lee et al. | |
| 5,540,276 | A | 7/1996 | Adams et al. | |
| 5,628,183 | A | 5/1997 | Rice | |
| 6,019,070 | A | 2/2000 | Duffy | |
| 6,055,803 | A | 5/2000 | Mastronarde | |
| 6,062,017 | A | 5/2000 | Liebig | |
| 6,173,679 | B1 | 1/2001 | Bruckner et al. | |
| 6,189,491 | B1 | 2/2001 | Wittchow et al. | |
| 6,244,330 | B1 | 6/2001 | Eisinger et al. | |
| 6,311,647 | B1 | 11/2001 | Liebig et al. | |
| 6,557,500 | B1 | 5/2003 | Schroeder | |
| 6,820,685 | B1 | 11/2004 | Carter et al. | |
| 6,868,807 | B2 | 3/2005 | Franke et al. | |
| 6,957,630 | B1 * | 10/2005 | Mastronarde | F22B 1/1815 122/406.4 |
| 7,017,529 | B1 | 3/2006 | Lomax, Jr. et al. | |
| 7,243,618 | B2 | 7/2007 | Gurevich | |
| 7,270,086 | B2 | 9/2007 | Franke et al. | |
| 7,428,374 | B2 | 9/2008 | Franke et al. | |
| 7,628,124 | B2 | 12/2009 | Brückner et al. | |
| 7,770,544 | B2 | 8/2010 | Viskup, Jr. | |
| 7,886,538 | B2 | 2/2011 | Schöttler et al. | |
| 7,963,097 | B2 | 6/2011 | Mastronarde | |
| 8,267,051 | B2 * | 9/2012 | Ando | F23N 3/065 122/14.31 |
| 8,757,248 | B2 | 6/2014 | Postma et al. | |
| 2001/0023665 | A1 | 9/2001 | Heidrich | |
| 2003/0051501 | A1 | 3/2003 | Matsushima et al. | |
| 2003/0164232 | A1 | 9/2003 | Inoue et al. | |
| 2004/0069244 | A1 | 4/2004 | Schroeder | |
| 2005/0194120 | A1 | 9/2005 | Lomax et al. | |
| 2007/0119388 | A1 | 5/2007 | Waseda et al. | |
| 2008/0104960 | A1 | 5/2008 | Lomax et al. | |
| 2008/0121387 | A1 | 5/2008 | Taniguchi et al. | |
| 2009/0071419 | A1 | 3/2009 | Franke et al. | |
| 2009/0241859 | A1 | 10/2009 | Bairley et al. | |
| 2010/0181053 | A1 | 7/2010 | Hecht et al. | |
| 2011/0056668 | A1 | 3/2011 | Taras et al. | |
| 2011/0162594 | A1 | 7/2011 | Bruckner et al. | |
| 2011/0174472 | A1 | 7/2011 | Kurochkin et al. | |
| 2011/0225972 | A1 | 9/2011 | Bruckner et al. | |
| 2011/0239961 | A1 | 10/2011 | Bauver, II et al. | |
| 2012/0180739 | A1 | 7/2012 | Rop et al. | |
| 2013/0062036 | A1 | 3/2013 | Treptow et al. | |
| 2014/0216365 | A1 | 8/2014 | Rancruel et al. | |

FOREIGN PATENT DOCUMENTS

| | | | |
|---|---|---|---|
| CN | 2429730 | Y | 5/2001 |
| CN | 1546191 | A | 11/2004 |
| CN | 1599853 | A | 3/2005 |
| CN | 1745227 | A | 3/2006 |
| CN | 1745277 | A | 3/2006 |
| CN | 101311624 | A | 11/2008 |
| CN | 201277766 | Y | 7/2009 |
| CN | 201476631 | U | 5/2010 |
| CN | 101726202 | A | 6/2010 |
| CN | 101784861 | A | 7/2010 |
| CN | 102128557 | A | 7/2011 |
| CN | 102239363 | A | 11/2011 |
| DE | 612960 | C | 5/1935 |
| FR | 1 324 002 | A | 4/1963 |
| GB | 191228236 | A | 12/1913 |
| GB | 104356 | A | 2/1917 |
| GB | 490457 | A | 8/1938 |
| GB | 717420 | A | 10/1954 |
| GB | 865426 | A | 4/1961 |
| GB | 913010 | A | 12/1962 |
| JP | 02075806 | A * | 3/1990 |
| JP | 645154 | B2 | 6/1994 |
| JP | 06-229503 | | 8/1994 |
| JP | H0663606 | | 9/1994 |
| JP | 6045154 | Y2 | 11/1994 |
| JP | 6341604 | A | 12/1994 |
| JP | 09243002 | A | 9/1997 |
| JP | 2000018501 | A | 1/2000 |
| JP | 2002206888 | A | 7/2002 |
| JP | 2008-180501 | | 8/2008 |
| KR | 1000284392 | B1 | 4/2001 |
| KR | 20010090529 | A | 10/2001 |
| KR | 20060132944 | A | 12/2006 |
| KR | 20070088654 | A | 8/2007 |
| KR | 1020090003233 | A | 1/2009 |
| KR | 20110009042 | U | 9/2011 |
| WO | 2004011046 | A1 | 2/2004 |
| WO | 2007/133071 | A2 | 11/2007 |
| WO | WO 2007133071 | * | 11/2007 |

OTHER PUBLICATIONS

US Non-Final Office Action Issued in connection with Related U.S. Appl. No. 13/744,126 on Dec. 18, 2014.

Unofficial English Translation of Chinese Office Action and Search Report issued in connection with Related CN Application No. 201380000535.2 on Dec. 23, 2014.

Unofficial English Translation of Korean Office Action issued in connection with Related KR Application No. 1020137021477 on Jan. 23, 2015.

(56) References Cited

OTHER PUBLICATIONS

Unofficial English Translation of Chinese Office Action and Search Report issued in connection with Related CN Application No. 201380000533.3 on Mar. 17, 2015.
US Non-Final Office Action Issued in connection with Related U.S. Appl. No. 13/744,112 on Jun. 19, 2015.
US Final Office Action Issued in connection with Related U.S. Appl. No. 13/744,126 on Jul. 21, 2015.
Unofficial English Translation of Mexican Office Action issued in connection with Related Application No. MX/a/2013/008238 on Jul. 27, 2015.
Unofficial English Translation of Korean Office Action issued in connection with Related KR Application No. 1020137021477 on Dec. 24, 2015.
US Final Office Action Issued in connection with Related U.S. Appl. No. 13/744,112 on Feb. 26, 2016.
Unofficial English Translation of Mexican Office Action Issued in connection with Related MX Application No. MX/a/2013/008237 on Apr. 5, 2016.
US Non-Final Office Action issued in connection with Related U.S. Appl. No. 13/744,126 on Jul. 28, 2016.
US Non-Final Office Action issued in connection with Related U.S. Appl. No. 13/744,112 on Aug. 11, 2016.
Wilhelm et al., U.S. Appl. No. 61/587,402, filed Jan. 17, 2012.
Magee, U.S. Appl. No. 13/744,104, filed Jan. 17, 2013.
Pschirer, U.S. Appl. No. 61/587,230, filed Jan. 17, 2012.
Truong et al., U.S. Appl. No. 13/744,112, filed Jan. 17, 2013.
Lech et al., U.S. Appl. No. 13/744,126, filed Jan. 17, 2013.
Magee et al., U.S. Appl. No. 13/744,094, filed Jan. 17, 2013.
International Search Report and Written Opinion issued in connection with related PCT Application No. PCT/IB2013/050455, dated Sep. 12, 2013.
International Invitation to Pay Additional Fees issued in connection with related PCT Application No. PCT/IB2013/050459 dated Feb. 24, 2014.
International Search Report and Written Opinion issued in connection with related PCT Application No. PCT/IB2013/050459, dated May 27, 2014.
Office Action issued in connection with related CN Application No. 201380000532.9 on Jan. 14, 2015.
Office Action issued in connection with related KR Application No. 10-2013-7019933 on Jan. 23, 2015.
Office Action issued in connection with related KR Application No. 10-2013-7021217 on Jan. 23, 2015.
Notice of Allowance issued in connection with related U.S. Appl. No. 13/744,104 on May 20, 2015.
Non-Final Rejection towards related U.S. Appl. No. 13/744,094 dated May 27, 2015.
Office Action issued in connection with corresponding CN Application No. 201380000531.4 on May 27, 2015.
Office Action issued in connection with related CN Application No. 201380000530.X on Sep. 6, 2015.
Office Action issued in connection with related ID Application No. W00201302867 on Nov. 5, 2015.
Notice of Allowance issued in connection with related KR Application No. 10-2013-7021217 on Nov. 27, 2015.
Final Rejection towards related application U.S. Appl. No. 13/744,094 dated Jan. 13, 2016.
Office Action issued in connection with related KR Application No. 10-2013-7019933 on Feb. 26, 2016.
Office Action issued in connection with related CN Application No. 201380000530.X on Apr. 25, 2016.
Office Action issued in connection with related EP Application No. 13707443.1 on May 25, 2016.
Non-Final Rejection towards related U.S. Appl. No. 13/744,094 dated Jun. 28, 2016.
Magee et al., U.S. Appl. No. 61/587,332, filed Jan. 17, 2012.
Magee, U.S. Appl. No. 61/587,428, filed Jan. 17, 2012.
Unofficial translation of Korean Office Action issued in connection with Related KR Application No. 1020137019933 on Jan. 23, 2015.
Unofficial translation of Korean Office Action issued in connection with Related KR Application No. 1020137019933 on Oct. 29, 2015.
Unofficial translation of Korean Notice of Allowance issued in connection with Related KR Application No. 1020137019933 on Oct. 27, 2016.
US Final Office Action issued in connection with Related U.S. Appl. No. 13/744,126 on Feb. 7, 2017.

* cited by examiner

FLOW CONTROL DEVICES AND METHODS FOR A ONCE-THROUGH HORIZONTAL EVAPORATOR

CROSS-REFERENCE TO RELATED APPLICATIONS

This disclosure claims priority to U.S. Provisional Application No. 61/587,332 filed Jan. 17, 2012, U.S. Provisional Application No. 61/587,428 filed Jan. 17, 2012, U.S. Provisional Application No. 61/587,359 filed Jan. 17, 2012, and U.S. Provisional Application No. 61/587,402 filed Jan. 17, 2012, the entire contents of which are all hereby incorporated by reference.

TECHNICAL FIELD

The present disclosure relates generally to a heat recovery steam generator (HRSG), and more particularly, to a method and apparatus for controlling flow in an HRSG having substantially horizontal and/or horizontally-inclined tubes for heat exchange.

BACKGROUND

A heat recovery steam generator (HRSG) is an energy recovery heat exchanger that recovers heat from a hot gas stream. It produces steam that can be used in a process (cogeneration) or used to drive a steam turbine (combined cycle). Heat recovery steam generators generally comprise four major components—the economizer, the evaporator, the superheater and the water preheater. In particular, natural circulation HRSG's contain an evaporator heating surface, a drum, as well as piping to facilitate an appropriate circulation rate in the evaporator tubes. A once-through HRSG replaces the natural circulation components with the once-through evaporator and in doing so offers in-roads to higher plant efficiency and furthermore assists in prolonging the HRSG lifetime in the absence of a thick walled drum.

An example of a once-through evaporator heat recovery steam generator (HRSG) 100 is shown in the FIG. 1. In the FIG. 1, the HRSG comprises vertical heating surfaces in the form of a series of vertical parallel flow paths/tubes 104 and 108 (disposed between the duct walls 111) configured to absorb the required heat. In the HRSG 100, a working fluid (e.g., water) is transported to an inlet manifold 105 from a source 106. The working fluid is fed from the inlet manifold 105 to an inlet header 112 and then to a first heat exchanger 104, where it is heated by hot gases from a furnace (not shown) flowing in the horizontal direction. The hot gases heat tube sections 104 and 108 disposed between the duct walls 111. A portion of the heated working fluid is converted to a vapor and the mixture of the liquid and vaporous working fluid is transported to the outlet manifold 103 via the outlet header 113, from where it is transported to a mixer 102, where the vapor and liquid are mixed once again and distributed to a second heat exchanger 108. This separation of the vapor from the liquid working fluid is undesirable as it produces temperature gradients and efforts have to be undertaken to prevent it. To ensure that the vapor and the fluid from the heat exchanger 104 are well mixed, they are transported to a mixer 102, from which the two phase mixture (vapor and liquid) are transported to another second heat exchanger 108 where they are subjected to superheat conditions. The second heat exchanger 108 is used to overcome thermodynamic limitations. The vapor and liquid are then discharged to a collection vessel 109 from which they are then sent to a separator 110, prior to being used in power generation equipment (e.g., a turbine). The use of vertical heating surfaces thus has a number of design limitations.

In addition, there exists a gas-side temperature imbalance downstream of the heating surface as a direct result of the vertically arranged parallel tubes. These additional design considerations utilize additional engineering design and manufacturing, both of which are expensive. These additional features also necessitate periodic maintenance, which reduces time for the productive functioning of the plant and therefore result in losses in productivity. It is therefore desirable to overcome these drawbacks.

SUMMARY

Disclosed herein is a once-through evaporator comprising an inlet manifold; one or more inlet headers in fluid communication with the inlet manifold; one or more tube stacks, where each tube stack comprises one or more substantially horizontal evaporator tubes; the one or more tube stacks being in fluid communication with the one or more inlet headers; one or more outlet headers in fluid communication with one or more tube stacks; an outlet manifold in fluid communication with the one or more outlet headers; and a plurality of flow control devices to dynamically control the fluid flow to a respective inlet header.

Disclosed herein is a method comprising discharging a working fluid through a once-through evaporator; where the once-through evaporator comprises an inlet manifold; one or more inlet headers in fluid communication with the inlet manifold; one or more tube stacks, where each tube stack comprises one or more substantially horizontal evaporator tubes; the one or more tube stacks being in fluid communication with the one or more inlet headers; one or more outlet headers in fluid communication with one or more tube stacks; and an outlet manifold in fluid communication with the one or more outlet headers; and discharging a hot gas from a furnace or boiler through the once-through evaporator; where a direction of flow of hot gas is perpendicular to a direction of flow of the working fluid; and measuring a parameter of the working fluid with a sensor; changing a rate of discharge of the working fluid through the once-through evaporator if the parameter lies outside a desired value; where the change in the rate of discharge is brought about by a flow control device.

Disclosed herein too is a once-through evaporator comprising an inlet manifold; one or more inlet headers in fluid communication with the inlet manifold; one or more tube stacks, where each tube stack comprises one or more substantially horizontal evaporator tubes; the one or more tube stacks being in fluid communication with the one or more inlet headers; one or more outlet headers in fluid communication with one or more tube stacks; an outlet manifold in fluid communication with the one or more outlet headers; and a flow choking device to restrict the fluid flow to at least one of an inlet header and an evaporator tube, and/or from at least one of an outlet header and evaporator tube.

Disclosed herein is a method comprising discharging a working fluid through a once-through evaporator; where the once-through evaporator comprises an inlet manifold; one or more inlet headers in fluid communication with the inlet manifold; one or more tube stacks, where each tube stack comprises one or more substantially horizontal evaporator tubes; the one or more tube stacks being in fluid communication with the one or more inlet headers; one or more outlet headers in fluid communication with one or more tube stacks; and an outlet manifold in fluid communication with the one or more outlet headers; and discharging a hot gas from a furnace or boiler through the once-through evaporator; where a direction of flow of hot gas is perpendicular to a direction of flow of the working fluid; and changing a rate of discharge of the working fluid through the once-through evaporator by a flow choking device; where the flow choking device is operative to restrict the fluid flow to at least one of an inlet header and an evaporator tube and/or from at least one of an outlet header and evaporator tube.

BRIEF DESCRIPTION OF THE DRAWINGS

Referring now to the Figures, which are exemplary embodiments, and wherein the like elements are numbered alike.

DETAILED DESCRIPTION

Figure 1:
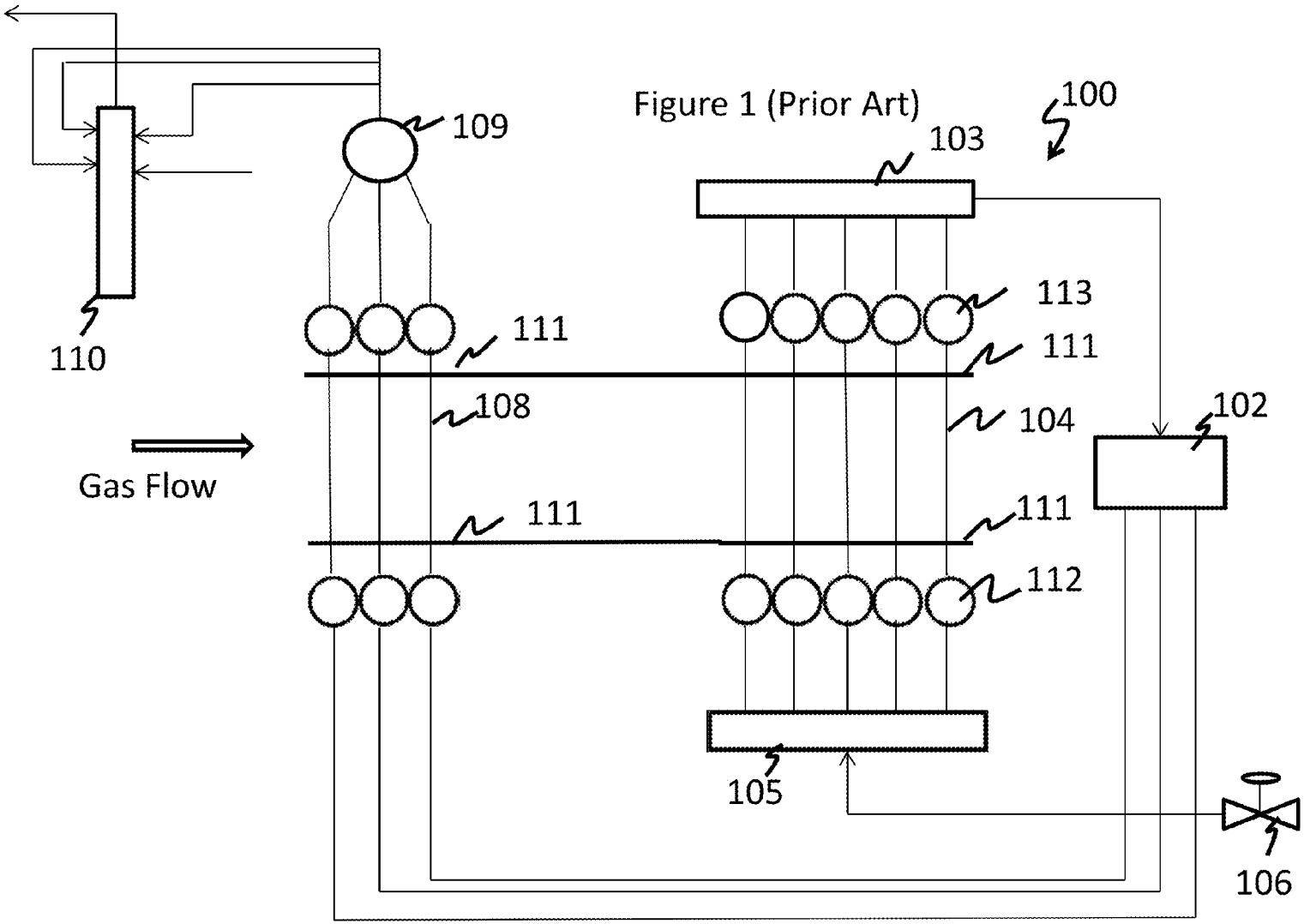
Figure 1 (Prior Art)
FIG. 1 is a schematic view of a prior art heat recovery steam generator having vertical heat exchanger tubes.

Disclosed herein is a heat recovery steam generator (HRSG) that comprises a single heat exchanger or a plurality of heat exchangers whose tubes are arranged to be substantially horizontal. By "substantially horizontal" it is implies that the tubes are oriented to be approximately horizontal (i.e., arranged to be parallel to the horizon within ±2 degrees). The section (or plurality of sections) containing the horizontal tubes is also termed a "once-through evaporator", because when operating in subcritical conditions, the working fluid (e.g., water, ammonia, or the like) is converted into vapor gradually during a single passage through the section from an inlet header to an outlet header. Likewise, for supercritical operation, the supercritical working fluid is heated to a higher temperature during a single passage through the section from the inlet header to the outlet header. The section of horizontal tubes is hereinafter referred to as a "tube stack".

The once-through evaporator (hereinafter "evaporator") comprises parallel tubes that are disposed horizontally in a direction that is perpendicular to the direction of flow of heated gases emanating from a furnace or boiler. The parallel tubes are serpentine in shape and the working fluid travels from inlet header to outlet header in directions that are parallel to each other but opposed in flow. In other words, the working fluid travels in one direction in a first section of the tube and then in an opposed direction in a second section of the tube that is adjacent and parallel to the first section but connected to it. This flow arrangement is termed counter flow since the fluid flows in opposite directions in different sections of the same tube.

During the once-through operation, a working fluid (e.g., steam) that is passed through the horizontal tubes displays a static head difference (i.e., a pressure difference) between the evaporator inlet and outlet because of the water or steam density difference at the two locations. Static head difference as well as non-uniform gas flow and temperature, will result in an uneven flow and heat absorption distribution among the evaporator tubes. In order to achieve a balanced flow through the tube, the once through evaporator is designed with a control system that can be used to control the flow of the working fluid. The control system effects its control over the once through evaporator by virtue of control valves. This arrangement is advantageous in that it permits a uniform working fluid flow distribution within the tube stacks.

The control system can be an open loop system or a closed loop system. In the open loop system, each control valve operates by a characteristic curve that defines the valves position at each load. These valves therefore function as variable orifices.

The control system comprises one or more control valves that are configured to operate under a closed-loop control scheme. Variables such as a temperature drop, a pressure drop, and the like, are monitored across each tube stack and the control valves are adjusted whenever these variables deviate from a desired value. For example, pressure drops across each evaporator section are used in feedback loops to provide a balanced fluid flow across each of the evaporator sections.

In one embodiment, all of the control valves are coordinated and controlled to achieve a balanced fluid pressure drop to balance flow distribution. In other words, the control system also prioritizes which imbalanced variables need to be dealt with. For example, if fluid temperature imbalance is above a certain range, fluid temperature control will be set at a higher priority than the fluid pressure control. The control valves can then be adjusted to keep the fluid temperature within an acceptable limit. Other feedback signals can similarly be included for prioritized control by the control system.

In another embodiment, the once-through evaporator comprises a flow-choking device (a restrictor) installed on each supply line that transports the working fluid from the inlet manifold to the inlet header. The flow choking device compensates for static head bias and improves evaporator flow distribution. The flow choking devices will be discussed in detail later.

Figure 2:
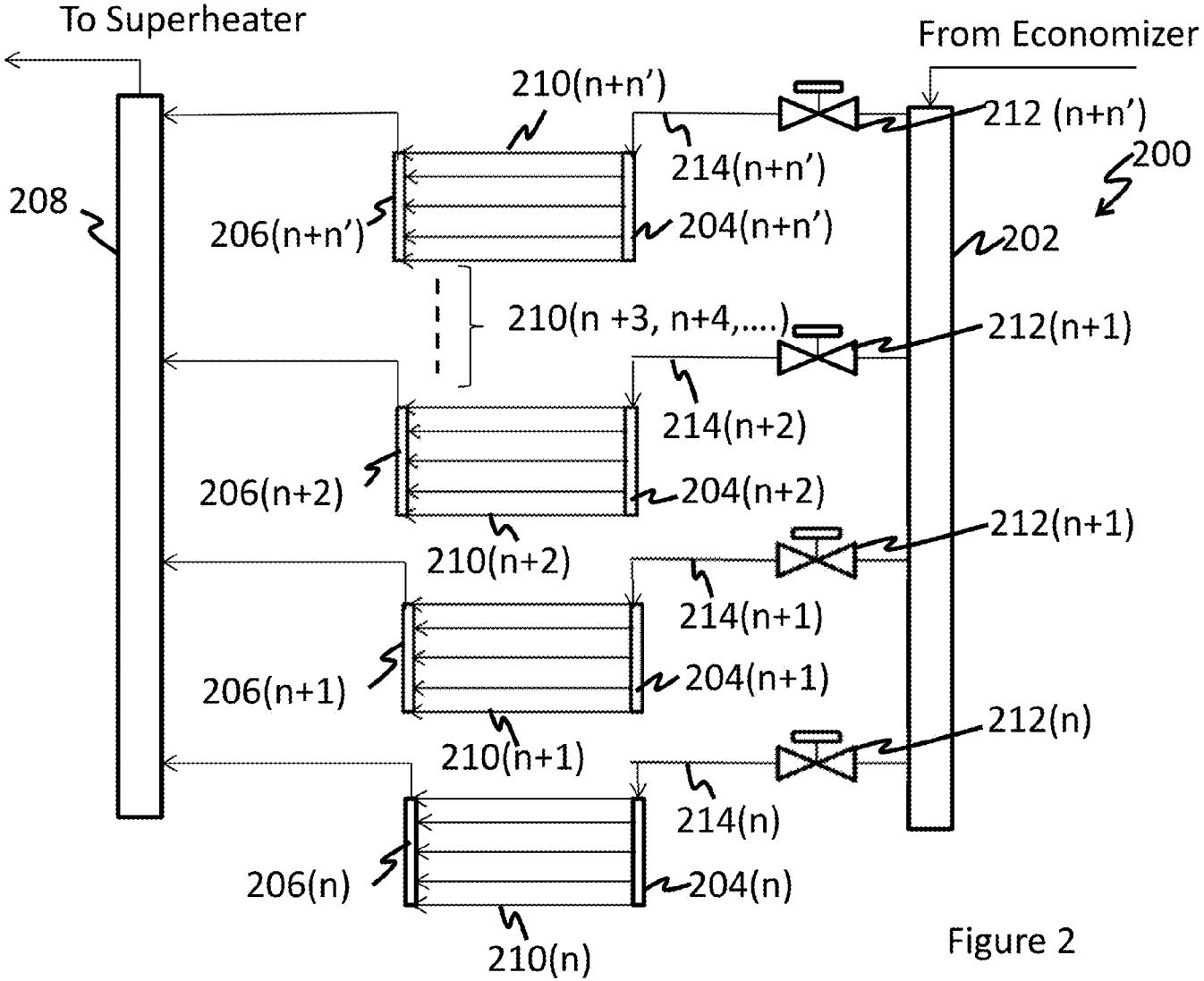
FIG. 2 depicts a schematic view of an exemplary once-through evaporator that uses control valves in an open loop control system.
Figures 13A, 13B:
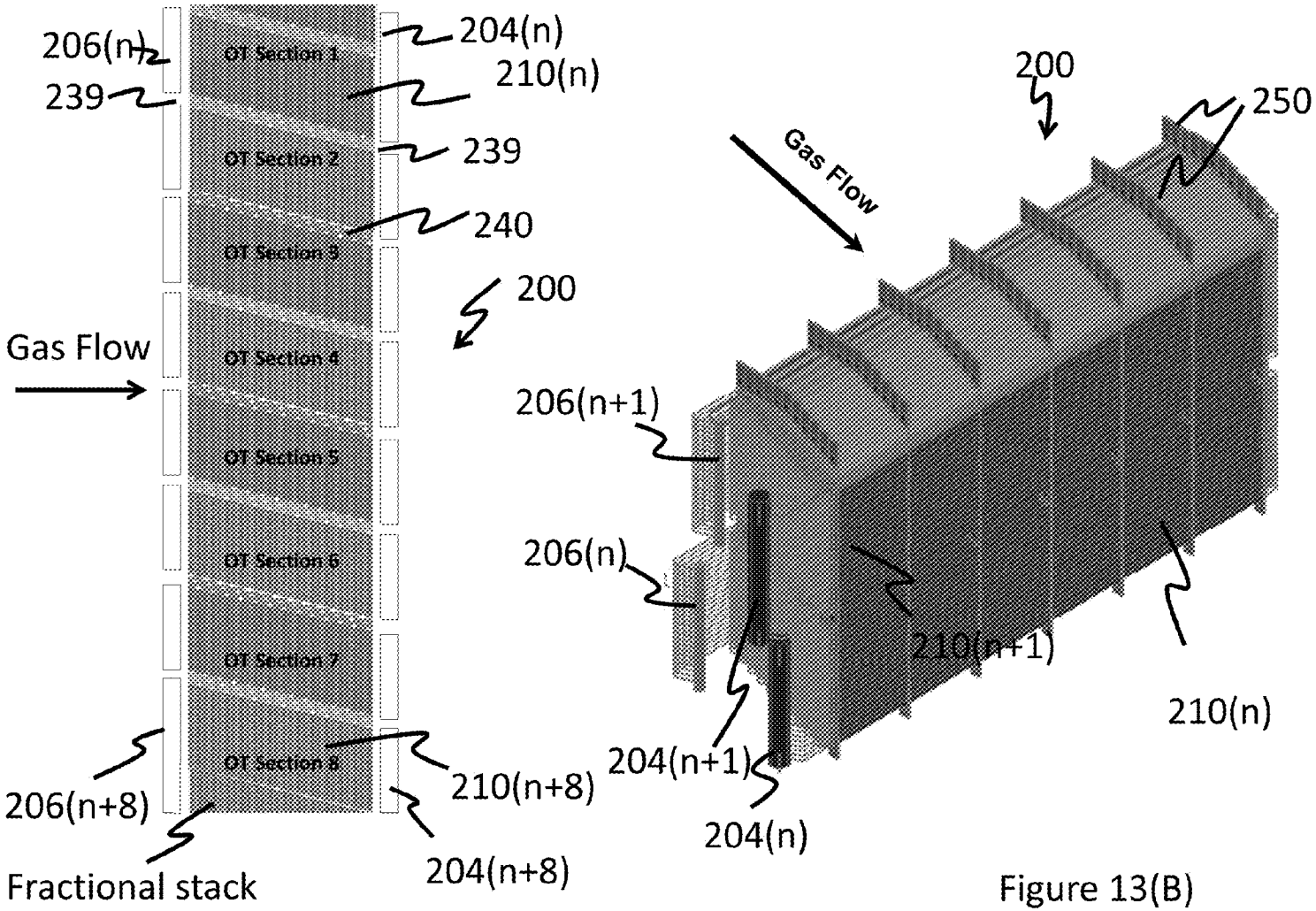
FIG. 13(A) depicts one exemplary arrangement of the tubes in a tube stack of a once-through evaporator.
FIG. 13(B) depicts an isometric view of an exemplary arrangement of the tubes in a tube stack of a once-through evaporator.
Figure 14:
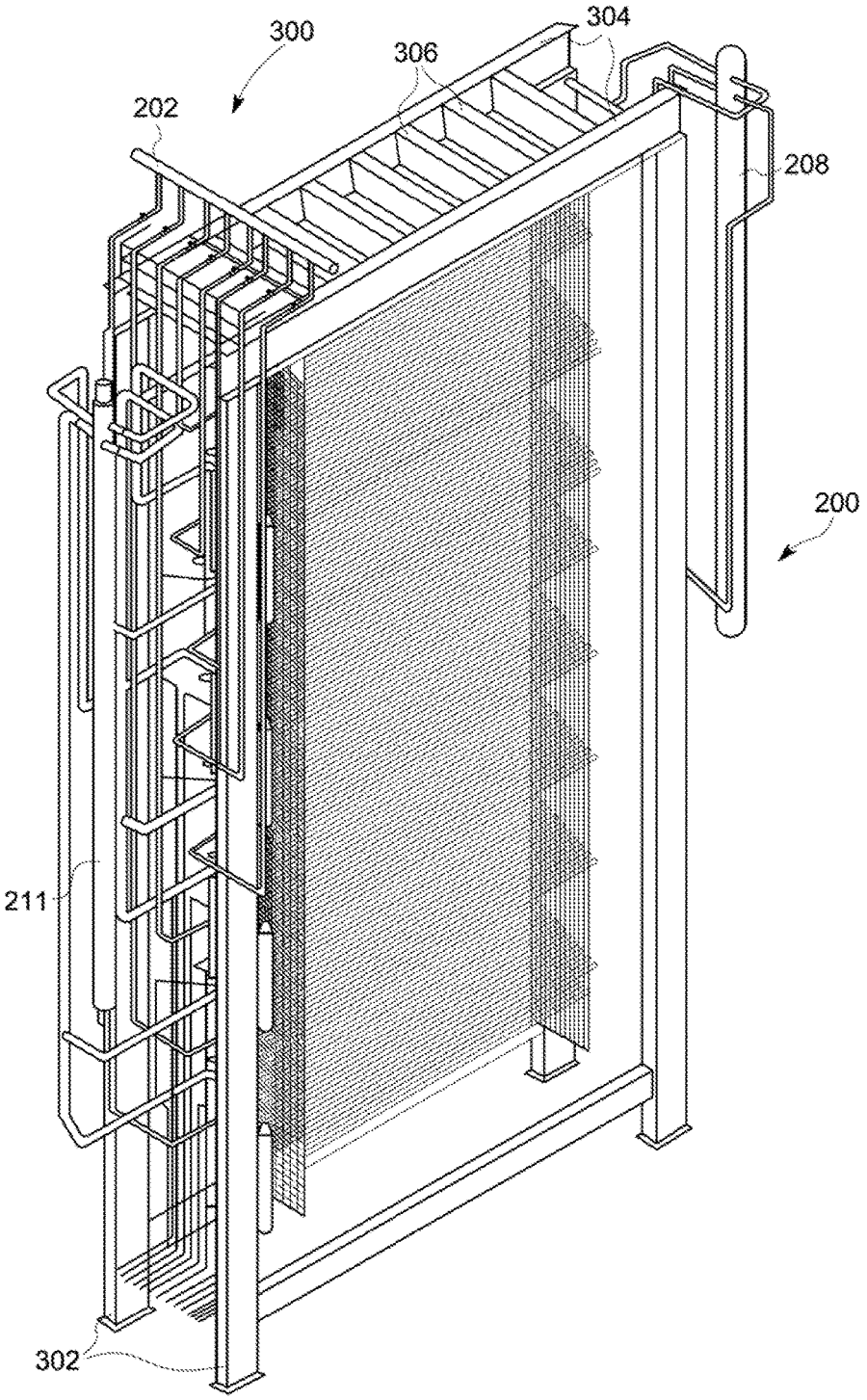
FIG. 14 depicts a once-through evaporator having 10 vertically aligned zones or sections that contain tubes through which hot gases can pass to transfer their heat to the working fluid.

The FIGS. 2, 13(A), 13(B) and 14 depict a plurality of tube stacks in a once-through evaporator 200 with their respective control systems. The FIG. 2 is a schematic depiction of an exemplary once-through evaporator 200 with a single control valve assigned to each supply line that serves as to transport the working fluid between an inlet manifold 202 and the vertically aligned tube stacks 210. The FIG. 13(A) depicts one exemplary arrangement of the tubes in a tube stack of a once-through evaporator while the FIG. 13(B) depicts an isometric view of an exemplary arrangement of the tubes in a tube stack of a once-through evaporator. The FIG. 14 depicts a once-through evaporator having 10 vertically aligned zones or sections that contain tubes through which hot gases can pass to transfer their heat to the working fluid.

The evaporator 200 comprises an inlet manifold 202, which receives a working fluid from an economizer (not shown) and transports the working fluid to a plurality of inlet headers 204(*n*), each of which are in fluid communication with vertically aligned tube stacks 210(*n*) comprising one or more tubes that are substantially horizontal. The fluid is transmitted from the inlet headers 204(*n*) to the plurality of tube stacks 210(*n*). For purposes of simplicity, in this specification, the plurality of inlet headers 204(*n*), 204(*n*+1) . . . and 204(*n*+*n'*), depicted in the figures are collectively referred to as 204(*n*). Similarly the plurality of tube stacks 210(*n*), 210(*n*+1), 210(*n*+2) . . . and 210(*n*+*n'*) are collectively referred to as 210(*n*) and the plurality of outlet headers 206(*n*), 206(*n*+1), 206(*n*+2) . . . and 206(*n*+*n'*) are collectively referred to as 206(*n*).

Figure 3:
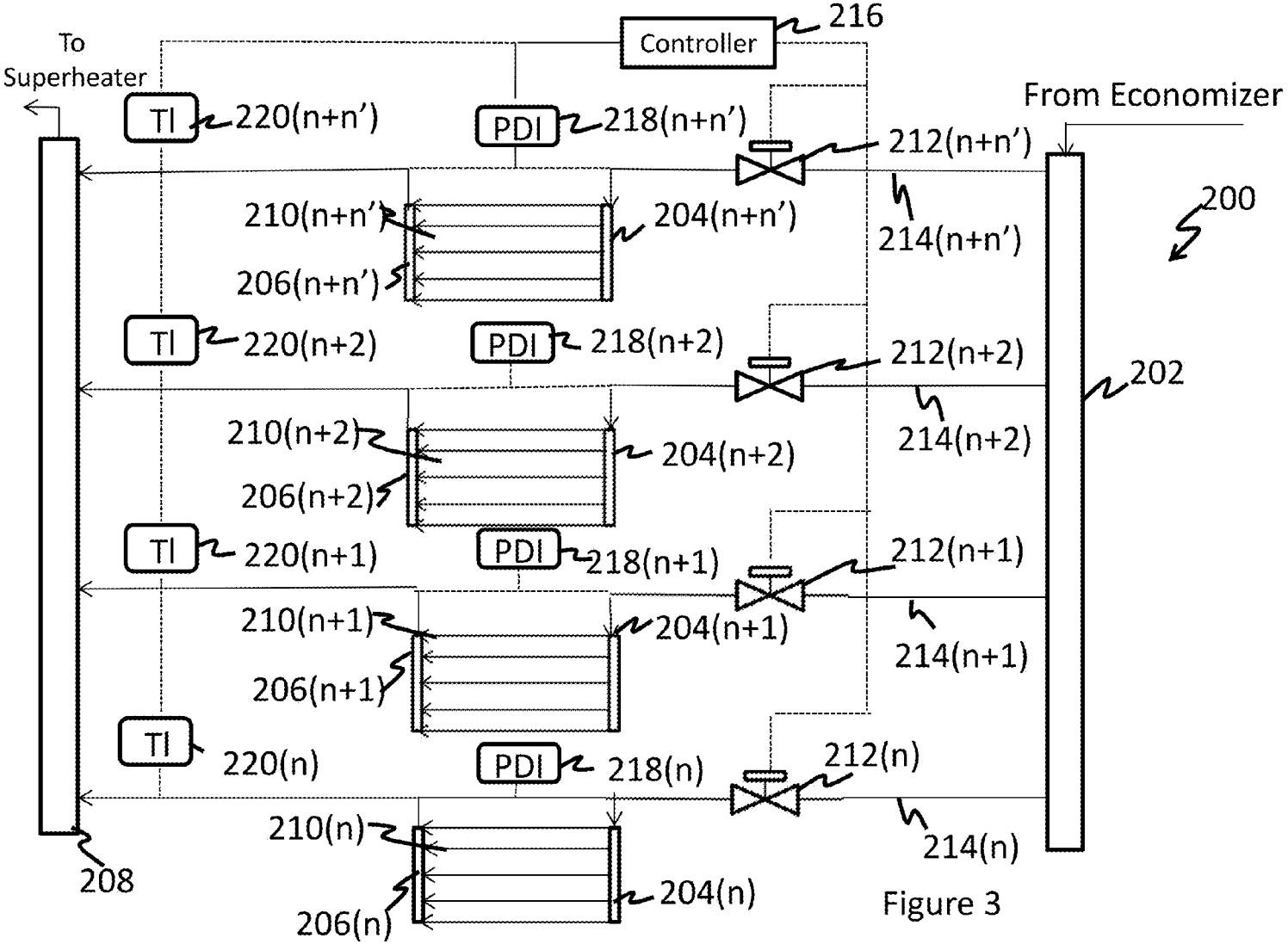
FIG. 3 depicts a schematic view of an exemplary once-through evaporator that uses control valves in a closed loop control system.

As can be seen in the FIGS. 2 and 3, multiple inlet tube stacks 210(*n*) are therefore respectively vertically aligned between a plurality of inlet headers 204(*n*) and outlet headers 206(*n*). Each tube of the tube stack 210(*n*) is supported in position by a plate (not shown). The working fluid upon traversing the tube stack 210(*n*) is discharged to the outlet manifold 208 from which it is discharged to the superheater. The inlet manifold 202 and the outlet manifold 208 can be horizontally disposed or vertically disposed depending upon space requirements for the once-through evaporator. The FIG. 2 shows a once-through evaporator with a vertical inlet manifold 202.

The hot gases from a furnace or boiler (not shown) travel perpendicular to the direction of the flow of the working fluid in the tubes 210. Heat is transferred from the hot gases to the working fluid to increase the temperature of the working fluid and to possibly convert some or all of the working fluid from a liquid to a vapor. Details of each of the components of the once-through evaporator are provided below.

As seen in the FIG. 2, the inlet header comprises or more inlet headers 204(*n*), 204(*n*+1) . . . and (204(*n*) (hereinafter represented generically by the term "204(*n*)"), each of which are in operative communication with an inlet manifold 202. In one embodiment, each of the one or more inlet headers 204(*n*) are in fluid communication with an inlet manifold 202. The inlet headers 204(*n*) are in fluid communication with a plurality of horizontal tube stacks 210(*n*), 210(*n*+1), 210(*n'*+2) . . . and 210(*n*) respectively ((hereinafter termed "tube stack" represented generically by the term "210(*n*)"). Each tube stack 210(*n*) is in fluid communication with an outlet header 206(*n*). The outlet header thus comprises a plurality of outlet headers 206(*n*), 206(*n*+1), 206(*n*+2) . . . and 206(*n*), each of which is in fluid communication with a tube stack 210(*n*), 210(*n*+1), 210(*n*+2) . . . and 210(*n*) and an inlet header 204(*n*), 204(*n*+1), (204(*n*+2) . . . and (204(*n*) respectively.

The terms 'n" is an integer value, while "n'" can be an integer value or a fractional value. n' can thus be a fractional value such as ½, ⅓, and the like. Thus for example, there can therefore one or more fractional inlet headers, tube stacks or outlet headers. In other words, there can be one or more inlet headers and outlet headers whose size is a fraction of the other inlet headers and/or outlet headers. Similarly there can be tube stacks that contain a fractional value of the number of tubes that are contained in another stack. It is to be noted that the valves and control systems having the reference numeral n' do not actually exist in fractional form, but may be downsized if desired to accommodate the smaller volumes that are handled by the fractional evaporator sections.

The FIG. 3(A) depicts 8 vertically aligned tube stacks that contain horizontally disposed tubes. The tube stacks 210(*n*) have a space 239 disposed between the tube stacks into which is placed a baffle 240 that deflects the hot gases into the tube stacks above and below the space 239. The FIG. 3(A) has a fractional tube stack disposed in the space 270. The FIG. 3(B) is an isometric view of a once-through evaporator that contains two vertically aligned tube sections showing the alignment of the tubes relative to the direction of flow of the hot gases.

The FIG. 14 depicts another exemplary assembled once-through evaporator. The FIG. 14 shows a once-through evaporator having 10 vertically aligned tube stacks 210(*n*) that contain tubes through which hot gases can pass to transfer their heat to the working fluid. The tube stacks are mounted in a frame 300 that comprises two parallel vertical support bars 302 and two horizontal support bars 304. The support bars 302 and 304 are fixedly attached or detachably attached to each other by welds, bolts, rivets, screw threads and nuts, or the like.

As shown in FIG. 14, the evaporator 200 includes a separator 211 defining a length disposed generally perpendicular to the length of the tubes of the tube stacks 210(*n*). Each of the tube stacks 210(*n*) is fluidly coupled to the separator 211.

Disposed on an upper surface of the once-through evaporator are rods 306 that contact the plates 250. Each rod 306 supports the plate and the plates hang (i.e., they are suspended) from the rod 306. The plates 250 (as detailed above) are locked in position using clevis plates. The plates 250 also support and hold in position the respective tube stacks 210(*n*). In this FIG. 14, only the uppermost tube and the lowermost tube of each tube tack 210(*n*) is shown as part of the tube stack. The other tubes in each tube stack are omitted for the convenience of the reader and for clarity's sake.

Since each rod 306 holds or supports a plate 250, the number of rods 306 are therefore equal to the number of the plates 250. In one embodiment, the entire once-through evaporator is supported and held-up by the rods 306 that contact the horizontal rods 304. In one embodiment, the rods 306 can be tie-rods that contact each of the parallel horizontal rods 304 and support the entire weight of the tube stacks. The weight of the once-through evaporator is therefore supported by the rods 306.

Each section is mounted onto the respective plates and the respective plates are then held together by tie rods 300 at the periphery of the entire tube stack. A number of vertical plates support these horizontal heat exchangers. These plates are designed as the structural support for the module and provide support to the tubes to limit deflection. The horizontal heat exchangers are shop assembled into modules and shipped to site. The plates of the horizontal heat exchangers are connected to each other in the field.

In one embodiment, the once-through evaporator can comprise 2 or more inlet headers in fluid communication with 2 or more tube stacks which are in fluid communication with 2 or more outlet headers. In one embodiment, the once-through evaporator can comprise 3 or more inlet headers in fluid communication with 3 or more tube stacks which are in fluid communication with 3 or more outlet headers. In another embodiment, the once-through evaporator can comprise 5 or more inlet headers in fluid communication with 5 or more tube stacks which are in fluid communication with 5 or more outlet headers. In yet another embodiment, the once-through evaporator can comprise 10 or more inlet headers in fluid communication with 10 or more tube stacks which are in fluid communication with 10 or more outlet headers. There is no limitation to the number of tube stacks, inlet headers and outlet headers that are in fluid communication with each other and with the inlet manifold and the outlet manifold. Each tube stack is termed a zone.

The FIG. 2 depicts an open loop system for controlling the fluid flow in the once-through evaporator. In the FIG. 2, each fluid supply line 214(*n*) between the inlet manifold 202 and the inlet headers 204(*n*) is provided with a control valve 212(*n*). Control valves 212(*n*) are valves used to control conditions such as flow, pressure, temperature, and liquid level by fully or partially opening or closing in response to signals received from controllers that compare a "setpoint" to a "process variable" whose value is provided by sensors that monitor changes in such conditions. The opening or closing of control valves is usually done automatically by electrical, hydraulic or pneumatic actuators (not shown). Positioners may be used to control the opening or closing of the actuator based on electric or pneumatic signals. Since there is no feedback loop employed in the once-through evaporator shown in the FIG. 2, the system depicted in the FIG. 2 is an open loop system.

These control valves therefore function as variable orifices and when the load on a particular evaporator section varies from a given set point on a process variable curve, the valve either opens or closes to permit more working fluid or less working fluid respectively into the evaporator section. By doing this a greater balance is maintained in the particular evaporator section. The valves are selected from the group consisting of ball valves, sluice valves, gate valves, globe valves, diaphragm valves, rotary valves, piston valves, or the like. One or more valves may be used in a single line if desired. As noted above, each valve is fitted with an actuator.

The FIG. 3 depicts the exemplary once-through evaporator system 200 of the FIG. 2, with a central controller 216 that is in operative communication with the plurality of control valves 212(*n*), with a plurality of pressure differential sensors (Pressure Drop Instrument (PDI)) 218(*n*), and with a plurality of temperature sensors (TI) 220(*n*). The FIG. 3 depicts a closed loop system. From the FIG. 3 it can be seen that each evaporator section 210(*n*) is in fluid communication with a control valve 212(*n*) and in fluid communication with a pressure differential sensor 218(*n*) and a temperature sensor 220(*n*) respectively. The pressure differential sensor is located in or around the center of each evaporator section 210(*n*) and measured the pressure drop across each tube section 210(*n*), while the temperature sensor 220(*n*) is located outside of each evaporator section (i.e., in the outlet header) and measured temperature variations. The fluid pressure drops across each evaporator section 210(*n*) is sensed by the respective pressure differential sensor 218(*n*) and is used as a feedback signal for the controller 216 to adjust the respective control valves 212(*n*). Similarly, changes in temperature measured by the temperature sensors are used as feedback signals for the controller 216 to adjust the control valves 212(*n*). Other sensors such as mass flow rate sensors, volumetric sensors, optical sensors (for detection of phase separation), or the like, may also be used in conjunction with the central controller. In other words, other feedback signals such as mass or volumetric flow rate, rate of phase separation of the liquid from the vapor, and the like, may be used for controlling the balance in the device.

Since information from the fluid line 214(*n*) is obtained up by the controller 216 and used to control the fluid flow in the fluid line via the respective valve 212(*n*), the system depicted in the FIG. 3 is a closed loop. The controller 216 may collect information from the plurality of tube sections 210(*n*) and fluid flow lines 214(*n*) and adjust the fluid flow in some or all of the lines simultaneously or sequentially depending upon the performance desired of the system.

The central controller 216 controls the valves 212(*n*) based upon input received from the pressure differential sensor 218(*n*) and the temperature sensor 220(*n*). The central controller 216 also prioritizes the response based upon predetermined settings that are input by the user. For example, if a pressure deviation is greater than a temperature deviation, then the central controller 216 adjusts the control valves in such a manner to compensate for the pressure setting prior to dealing with the temperature deviation. If, on the other hand, fluid temperature deviates above a certain predetermined range, fluid temperature control can be set at a higher priority than the pressure control. One or more control valves can be adjusted to keep the fluid parameters within an acceptable limit. While the FIGS. 2 and 3 show that each fluid supply line 214(*n*) contains a control valve, it is envisioned that some lines may not contain valves (i.e., they may be uncontrolled). Additionally, while the FIG. 3 shows that each evaporator section 210(*n*) has a pressure differential sensor and a temperature sensor, it is envisioned that some of the evaporator sections may be fitted with only one of the two. Some evaporator sections may employ an open loop control system (as shown in the FIG. 2), while others may have closed control systems (as shown in the FIG. 3).

In another embodiment, the control of all valves 212(*n*) are coordinated by the central controller 216 to achieve a balanced fluid pressure drop (with some tolerance) and thus balanced flow distribution (or unbalanced distribution, if desired) in each of the evaporator sections 210(*n*).

In the embodiment shown in FIG. 3, the central controller 216 individually controls each of the flow control devices (i.e., valves 212(*n*)) in response to the pressure drop across a respective section or zone of evaporator tubes and/or the temperature at the outlet of a respective outlet header. In one instance, each respective flow control device is controlled by the pressure drop across the respective section or zone of evaporator tubes, provided the temperature at the outlet of the respective outlet header is within a certain temperature range. If the temperature is outside the acceptable temperature range, the controller controls the corresponding flow control device in response to the temperature until the temperature falls back to within the acceptable temperature range. While specific parameters have been shown to provide feedback for the control of the flow control valves 212(*n*), the present invention contemplates that any fluid parameter at any location may be used individually or in conjunction with a plurality of parameter. Furthermore, any system parameter, such as load on the system or thermal profile of the gas flow passing through the evaporator, may be used individually or in conjunction with any other input parameter.

In one embodiment, the central controller 216 can be in electrical communication with a computer or a microprocessor, where the data retrieved from the various sensors is stored for future analysis. The data can be used for adjusting setting future parameters for the sensors.

Figure 4:
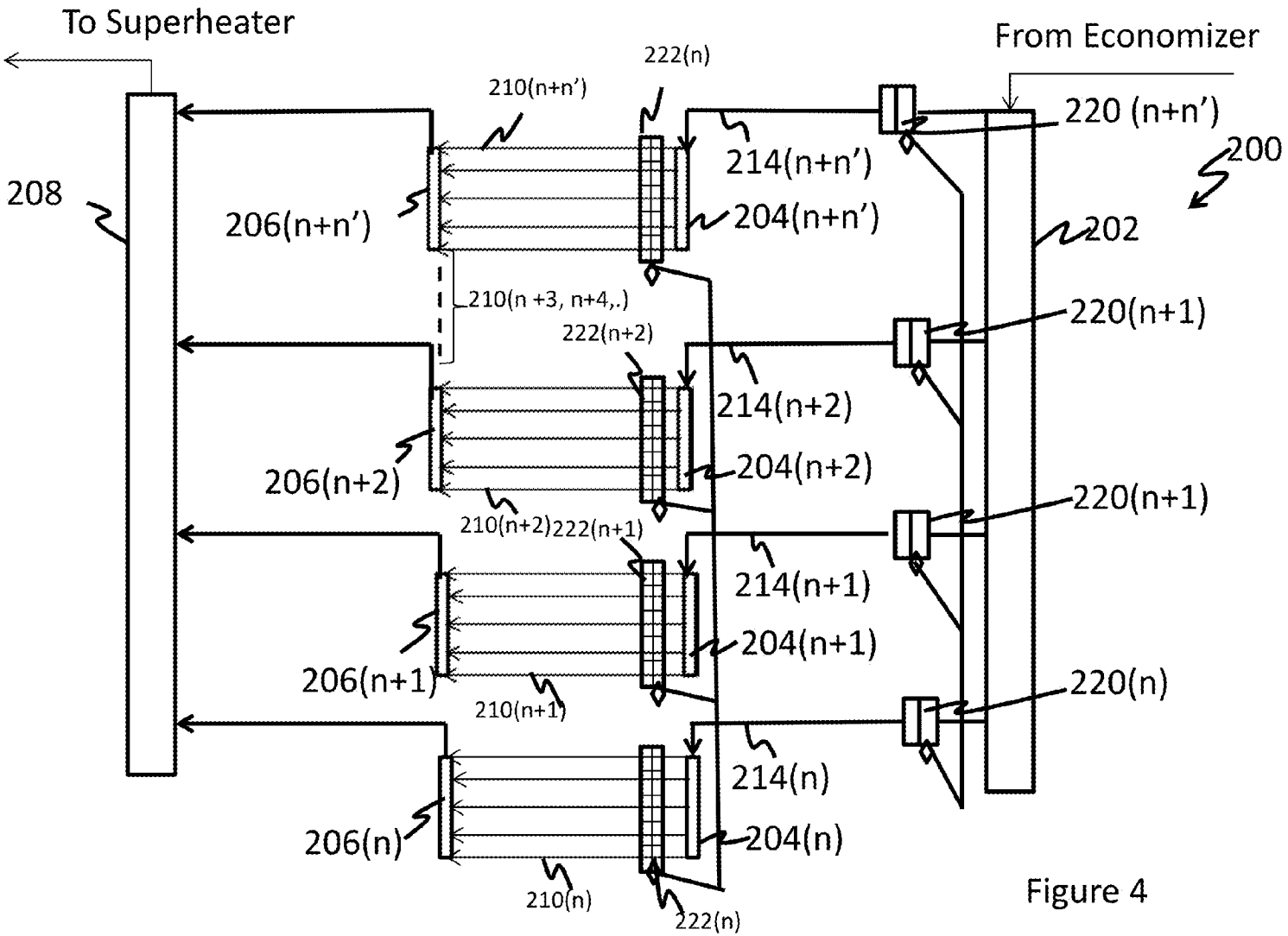
FIG. 4 depicts a schematic view of an exemplary once-through evaporator that uses flow choking devices and that has a vertical inlet manifold.
Figure 5:
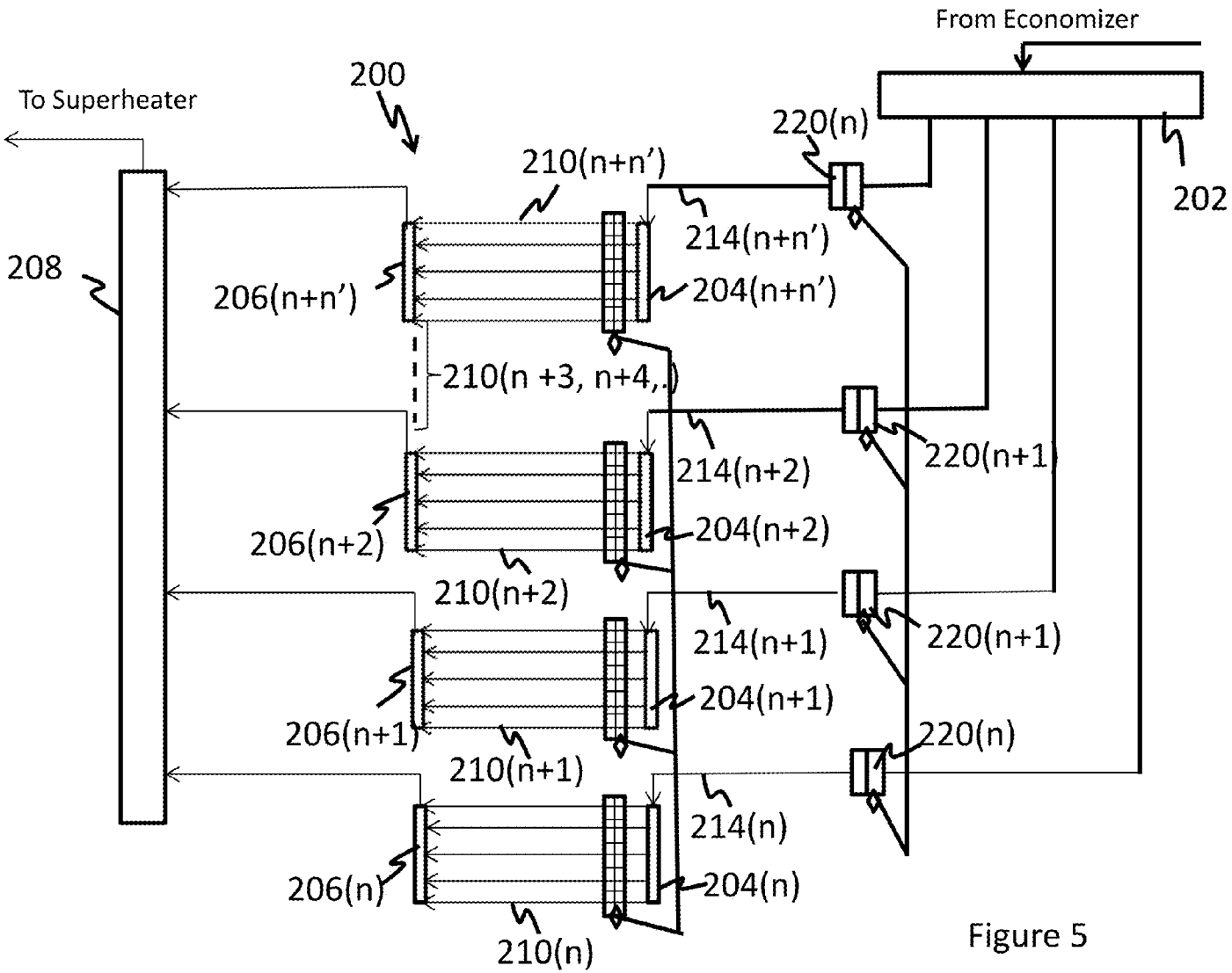
FIG. 5 depicts a schematic view of an exemplary once-through evaporator that uses flow choking devices and that has a horizontal inlet manifold.
Figure 6:
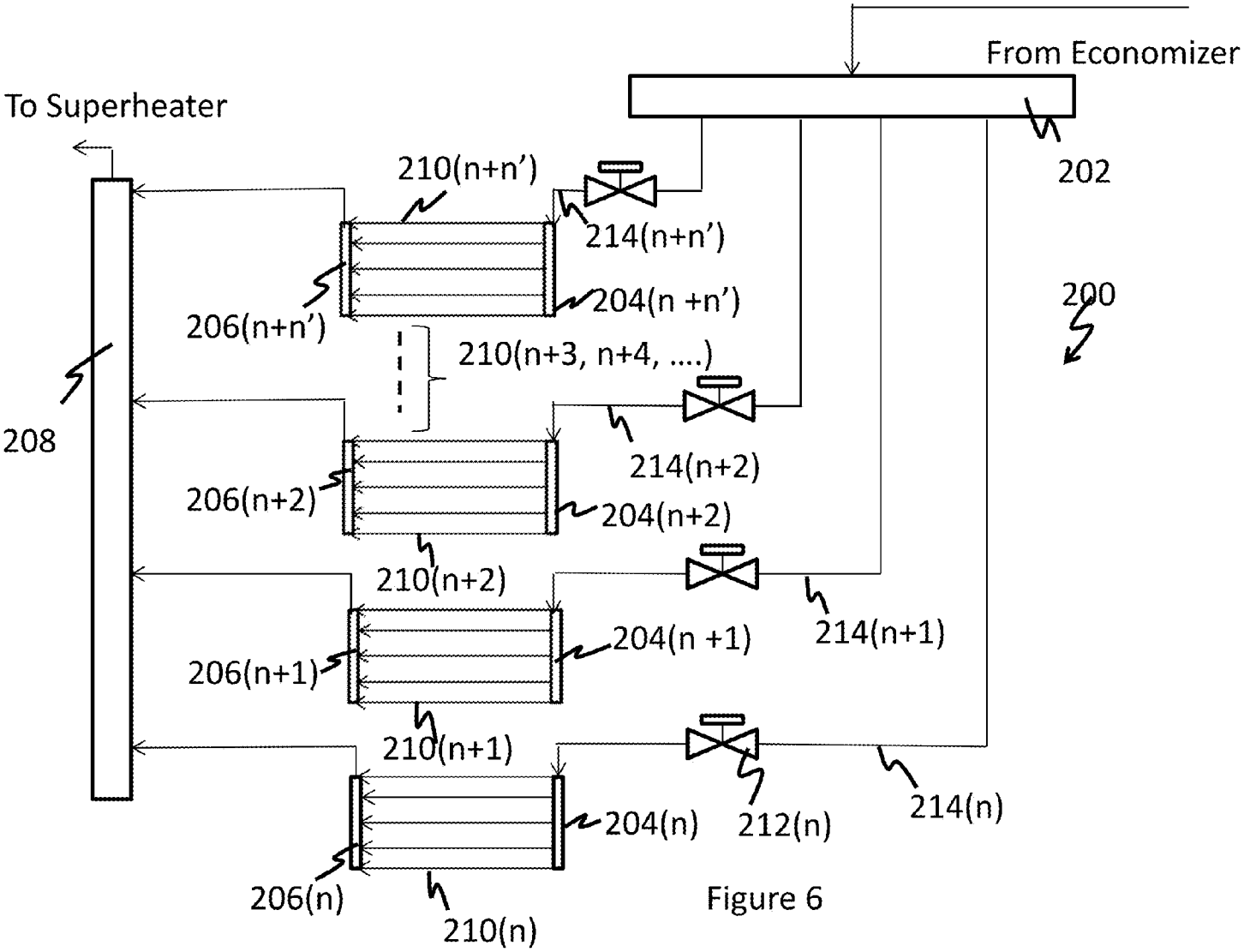
FIG. 6 depicts a schematic view of an exemplary once-through evaporator that uses an open control loop with control valves and that has a horizontal inlet manifold.
Figure 7:
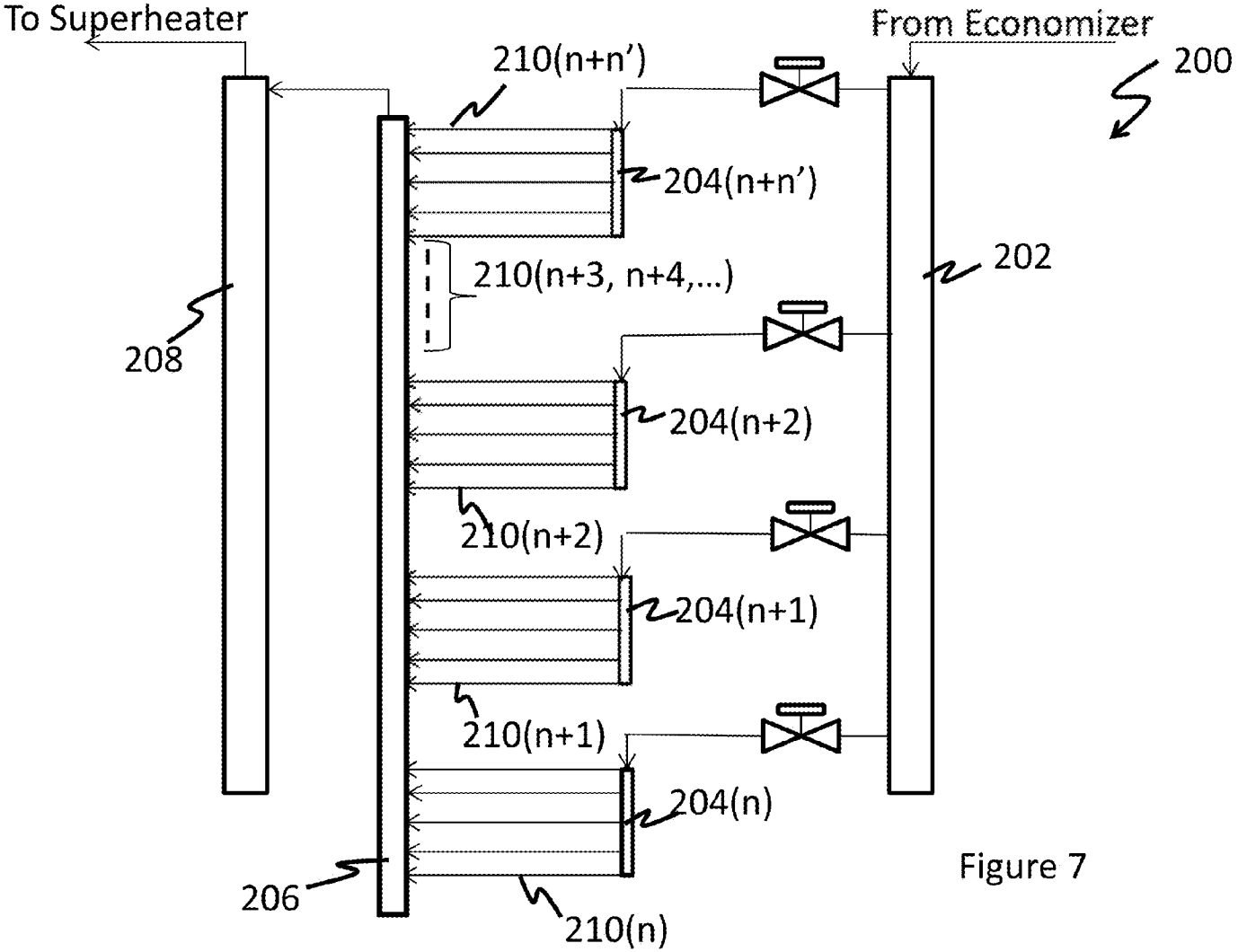
FIG. 7 depicts vertically aligned tube stacks that are in fluid communication with a plurality of inlet headers respectively, while at the same time being in fluid communication with a single outlet header; the system employs an open control loop with control valves.
Figure 8:
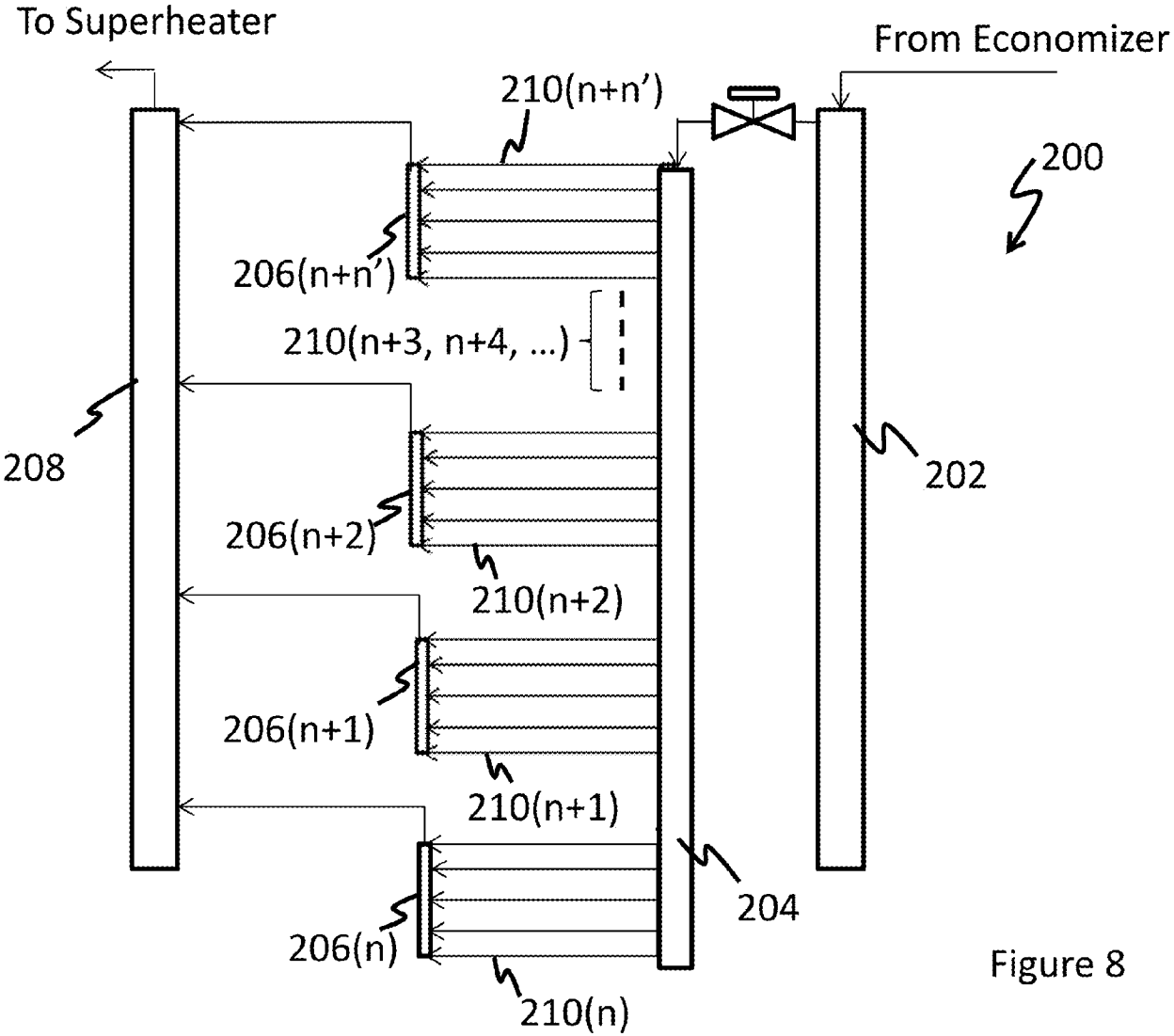
FIG. 8 depicts a plurality of vertically aligned tube stacks that are in fluid communication with a plurality of outlet headers respectively, while at the same time being in fluid communication with a single inlet header; the system employs an open control loop with control valves.
Figure 9:
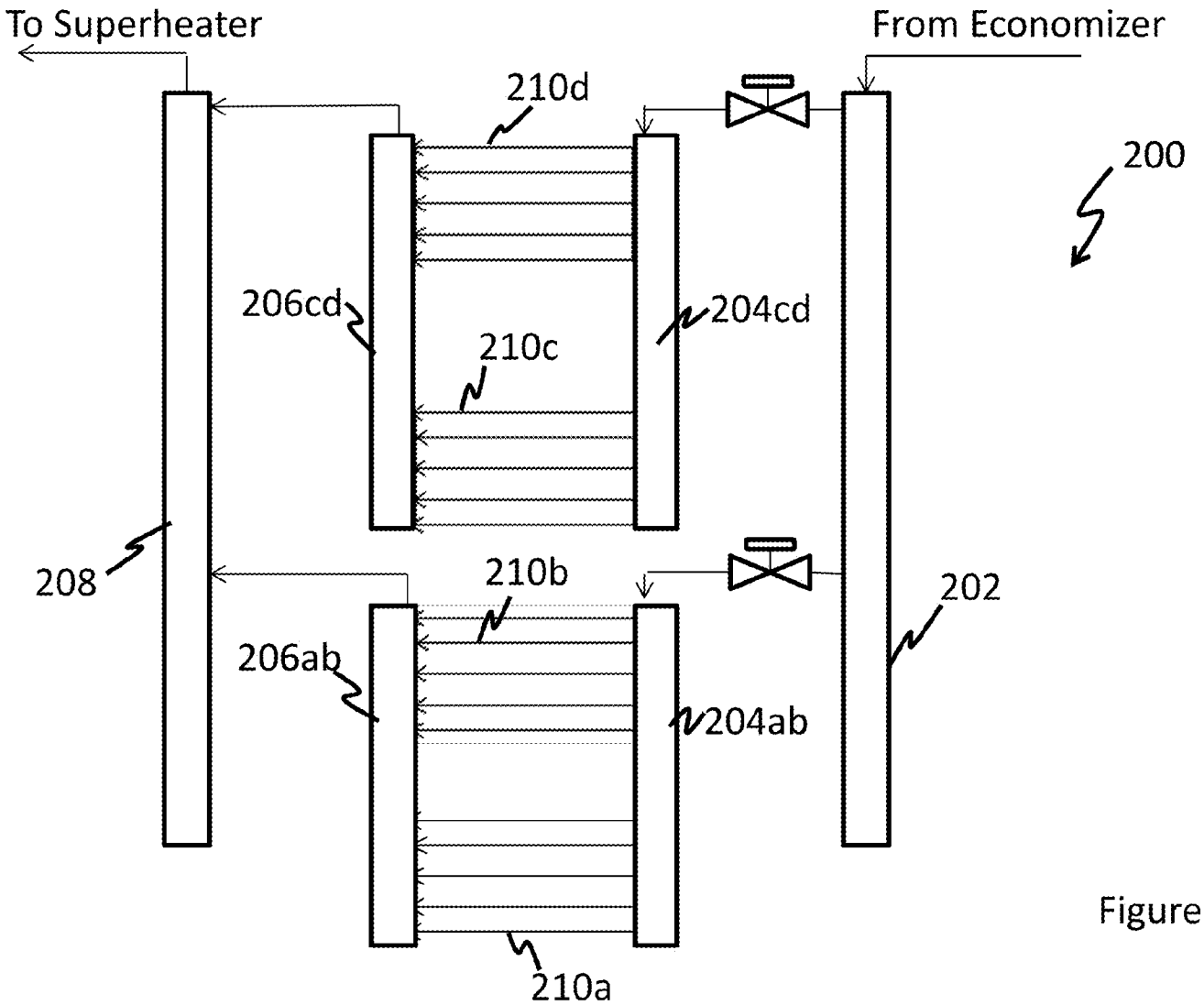
FIG. 9 depicts yet another arrangement of the vertically aligned stacks in the once-through evaporator. In the FIG. 8, two or more vertically aligned tube stacks are in fluid communication with a single inlet header and a single outlet header; the system employs an open control loop with control valves.
Figure 10:
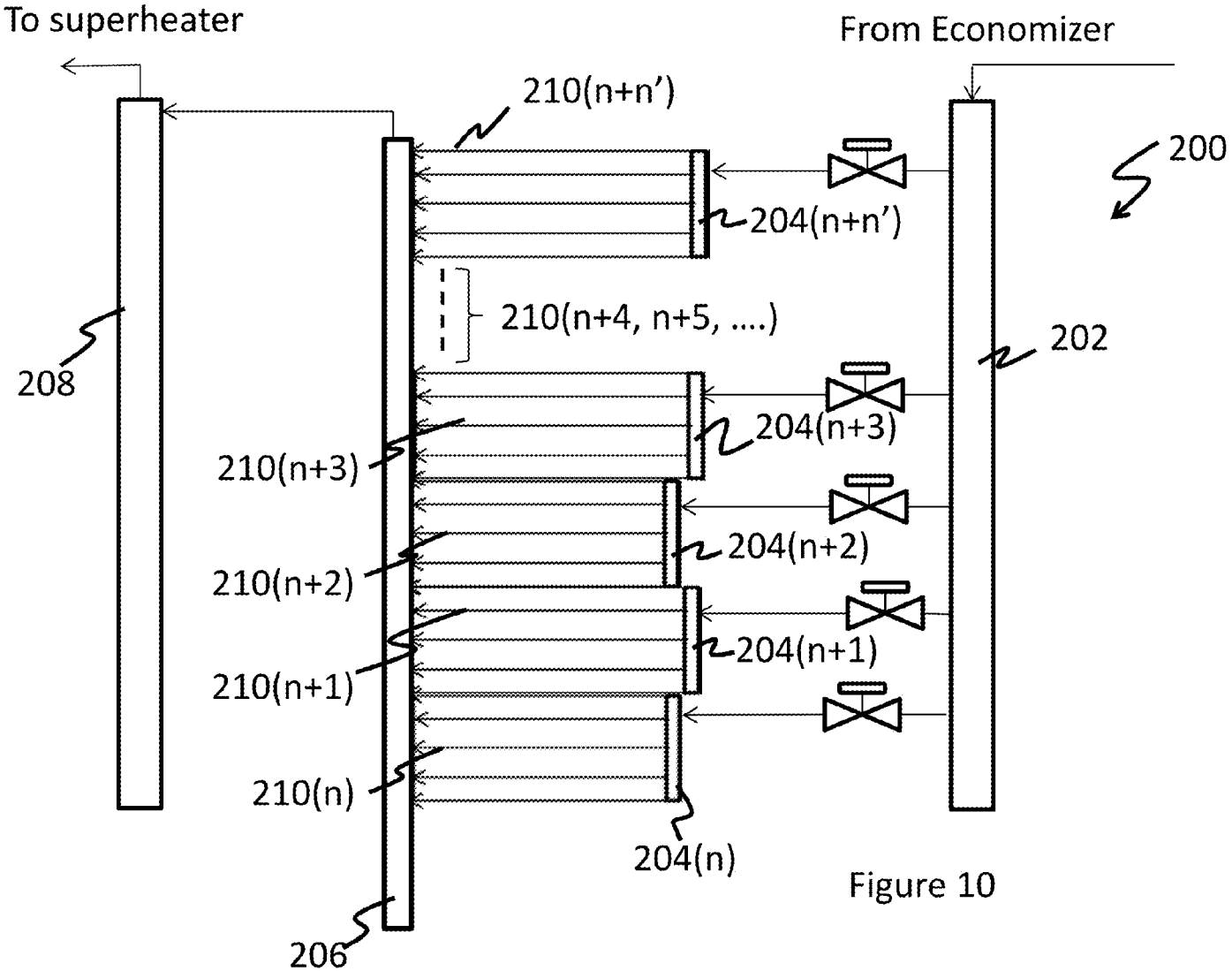
FIG. 10 shows separate zones (vertically aligned tube stacks) that are in fluid communication with a plurality of inlet headers; the system employs an open control loop with control valves.
Figure 11:
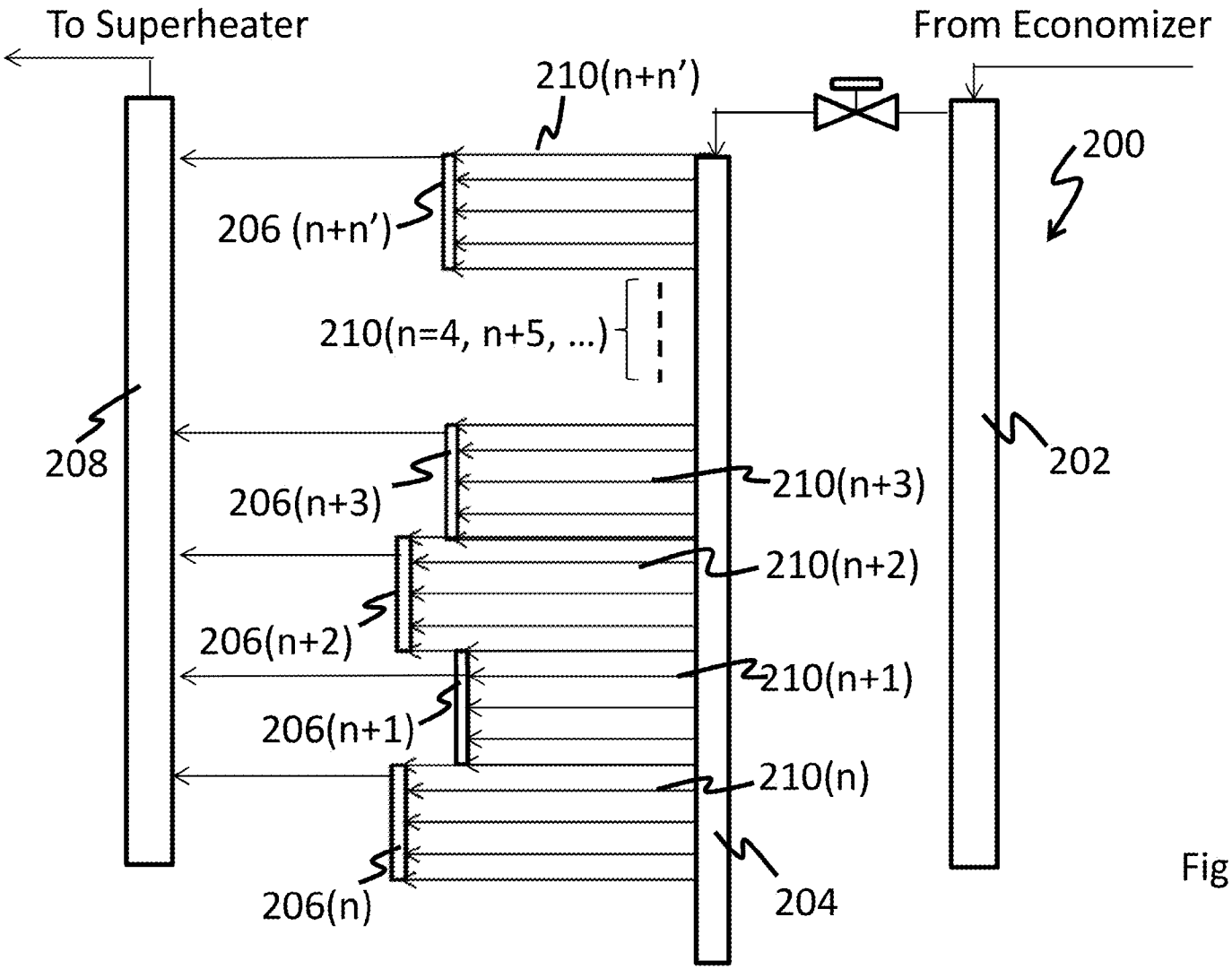
FIG. 11 shows separate zones (vertically aligned tube stacks) that are in fluid communication with a plurality of outlet headers; the system employs an open control loop with control valves.
Figure 12:
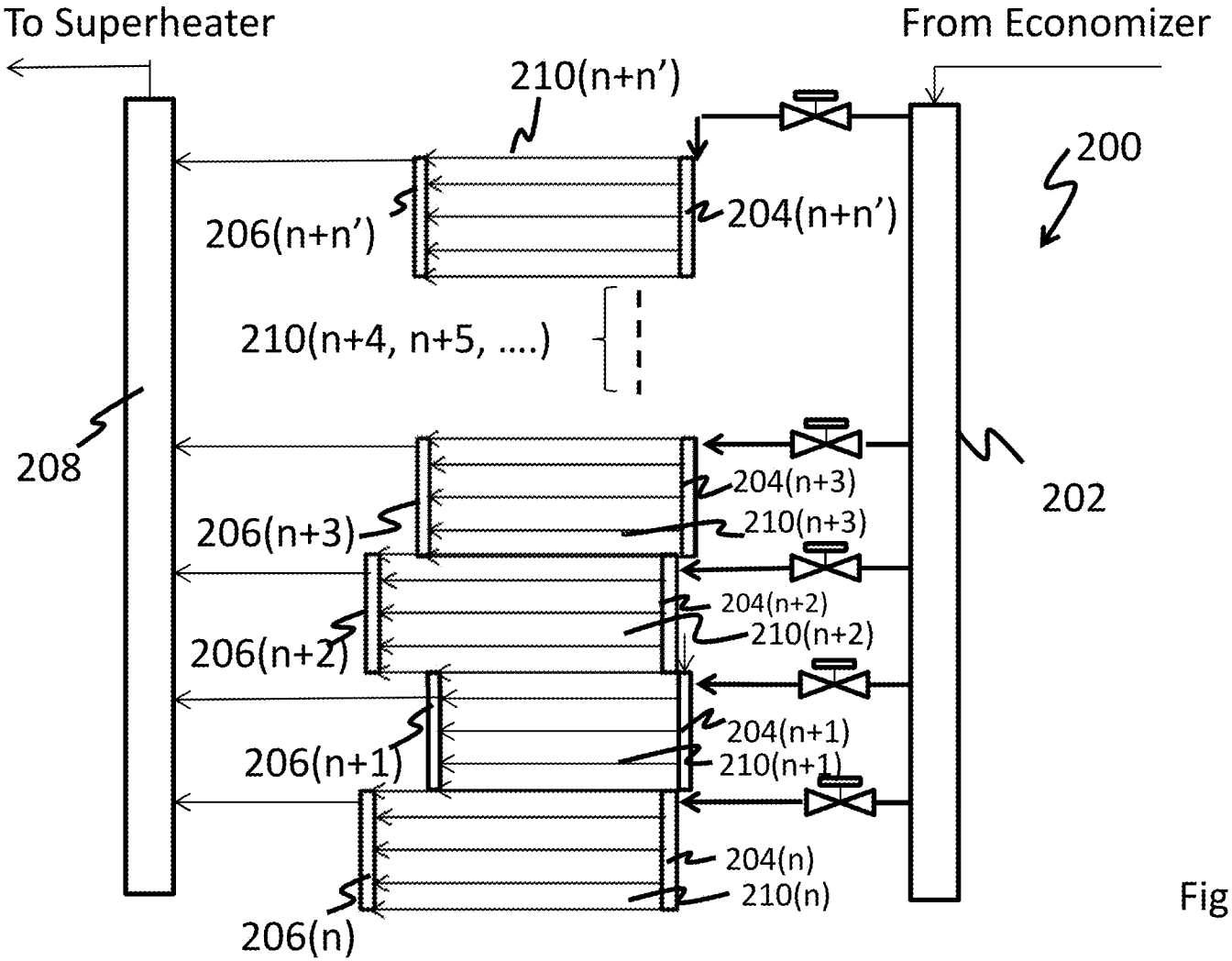
FIG. 12 shows separate zones (vertically aligned tube stacks) that are in fluid communication with a plurality of inlet headers and a plurality of outlet headers; the system employs an open control loop with control valves.

As noted above, the once-through evaporator comprises one or more flow choking device. As can be seen in the FIGS. 4 and 5, a first flow choking device 220(*n*) is installed on each supply line 214 leaving the common inlet manifold. A second flow choking device 222(*n*) is installed on each pipe in the tube stack 210(*n*). The FIG. 4 has a common vertical inlet manifold 202, while the FIG. 5 has a common horizontal inlet header 202 from which individual supply lines 214 transport the working fluid from the manifold to the respective inlet headers 204(*n*). While the FIGS. 4 and 5 show that each supply line 214(*n*) contains at least one flow choking device, there may be more than one flow choking device installed in a single supply line. In addition, some of the supply lines may not use a flow choking device. In a similar fashion, the tubes in the tube stack 210(*n*) may or may not use the flow choking device. In other words, the flow choking device is optional and is typically used when the net static head on a flow path is up to 50% of the total friction pressure loss for this flow path.

The first flow choking device 220(*n*) compensates for static head bias and improves evaporator flow distribution. The additional friction loss from the flow choking device will reduce the impact on flow distribution due to static head differences between once through evaporator sections. The flow choking device is sized such that at any operational load, the net static head on each flow path to which this choking device is connected is up to about 50%, specifically up to about 40%, and specifically up to 30% of the total friction pressure loss in this particular flow path. If this condition is met without the pressure drop from the flow choking device, then the use of the flow choking device is optional. Here, the flow path is defined as the path through which water/steam has to flow between the inlet of the inlet manifold and the outlet of the outlet manifold.

The second flow choking device 222(*n*) provides static control of the flow distribution through each section or zone of evaporator tubes and/or individual control of tubes within a section or zone of tubes. The second flow choking device 222(*n*) can be placed on each tube, or on each tube group containing multiple tubes.

The first and second flow choking device includes any device that restricts the flow of fluid, such as an orifice, venturi, restrictor plates, a nozzle, or reduced sizing of tubing. One will also appreciate that the present invention contemplates that while the flow choking devices are located at the inlet end of the evaporator and sections, the choking devices may also be located at the outlet side of the tubes in the tube stack 210(*n*) and/or the outlet of the outlet headers 208. In fact, the flow choking devices may be located in any of these inlet and outlet locations in any combination. Also, flow rate as a result of the flow choking devices may vary by section or zone, and/or by individual tubes.

Flow choking devices can be located within the inlet header or on tubes leaving the inlet header and may be designed with one uniform size or different sizes. The flow choking device and tubes are sized such that at all operational loads the static head difference between the inlet and outlet header on each section is no more than 25% of the total friction pressure loss through this section.

In one embodiment, the once through evaporator 200 can employ both a flow choking device and a control valve. The control valve may be part of an open loop or a closed loop system. The FIGS. 6-12 show various configurations for the once-through evaporator, all of which can employ the open loop control system depicted in the FIG. 2. While the FIGS. 6-12 show the open loop system of the FIG. 2, it is envisioned that the closed control loop system depicted in the FIG. 3 can also be used in these once-through evaporator systems. Alternatively, as described above, the once-through systems depicted in the FIGS. 6-12 can used both the flow choking device as well as the control valve. It can also be seen that the valves in the FIGS. 6-12 can be easily replaced with the flow choking devices if desired.

The flow control systems described herein are advantageous in that the flow control valve provides dynamic or variable control of the flow distribution through each section or zone of evaporator tubes. The flow control valve includes any device which can variably or dynamically control the fluid flow with a tube. One will also appreciate that the present invention contemplates that while the flow control valves are located at the inlet of the inlet headers of each evaporator section or zone, the choking devices may also be located at the outlet side of the outlet headers. In fact, the flow control valves may be located in any of these inlet and outlet locations in any combination. Also, flow rate as a result of the flow control valves may vary by section or zone. The present invention further contemplates that this method of dynamically or variably controlling the flow distribution in open loop or closed loop mode is applicable for all the embodiments provided hereinbefore. Furthermore, the control concepts presented here can be nested with large plant control systems (e.g., cascade control systems, once through controls, and the like).

It is to be noted that this application is being co-filed with Patent Applications having Alstom docket numbers W11/122-1, W 12/001-0, W11/123-1, W12/093-0, W11/120-1, W 11/121-0 and W12/110-0, the entire contents of which are all incorporated by reference herein. Maximum Continuous Load" denotes the rated full load conditions of the power plant.

"Once-through evaporator section" of the boiler used to convert water to steam at various percentages of maximum continuous load (MCR).

"Approximately Horizontal Tube" is a tube horizontally orientated in nature. An "Inclined Tube" is a tube in neither a horizontal position or in a vertical position, but dispose at an angle therebetween relative to the inlet header and the outlet header as shown.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, singular forms like "a," or "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

The term and/or is used herein to mean both "and" as well as "or". For example, "A and/or B" is construed to mean A, B or A and B.

The transition term "comprising" is inclusive of the transition terms "consisting essentially of" and "consisting of" and can be interchanged for "comprising".

While this disclosure describes exemplary embodiments, it will be understood by those skilled in the art that various changes can be made and equivalents can be substituted for elements thereof without departing from the scope of the disclosed embodiments. In addition, many modifications can be made to adapt a particular situation or material to the teachings of this disclosure without departing from the essential scope thereof. Therefore, it is intended that this disclosure not be limited to the particular embodiment disclosed as the best mode contemplated for carrying out this disclosure.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A once-through evaporator for carrying a working fluid comprising:

an inlet manifold;

a plurality of inlet headers in fluid communication with the inlet manifold;

a plurality of tube stacks, where each tube stack comprises one or more substantially horizontal evaporator tubes; each of the tube stacks being in fluid communication with one of the plurality of inlet headers;

a plurality of outlet headers, each outlet header being in fluid communication with one of the tube stacks;

an outlet manifold in fluid communication with each of the plurality of outlet headers;

each of the plurality of tube stacks aligned one above another in a direction perpendicular to a length of the evaporator tubes;

a plurality of flow control devices to dynamically control the flow of a working fluid to a respective inlet header;

a plurality of pressure sensors, each pressure sensor coupled to one of the tube stacks near a center thereof, each pressure sensor in fluid communication with a working fluid carried within the tube stack;

a plurality of temperature sensors, one of the temperature sensors located in each of the outlet headers for monitoring the temperature of a working fluid within the outlet header;

a controller in operative communication with the flow control devices, the pressure sensors and the temperature sensors, the controller being configured to achieve a balanced pressure drop in a working fluid to balance flow distribution between the plurality of tube stacks.

2. The once-through evaporator of claim 1, where the at least one of the plurality of flow control devices is a valve and is located between the inlet manifold and at least one of the inlet headers.

3. The once-through evaporator of claim 2, where the valve is in communication with an actuator.

4. The once-through evaporator of claim 1, where the controller regulates the valve based on a signal received from one of the pressures sensors or temperature sensor.

5. The once-through evaporator of claim 1, wherein each of the plurality of tube stacks are vertically aligned.

6. A method comprising:

discharging a working fluid through a once-through evaporator; where the once-through evaporator comprises:

an inlet manifold;

a plurality of inlet headers in fluid communication with the inlet manifold;

a plurality of tube stacks, where each tube stack comprises one or more substantially horizontal evaporator tubes; each of the tube stacks being in fluid communication with one of the plurality of inlet headers;

a plurality of outlet headers, each outlet header being in fluid communication with one of the tube stacks;

an outlet manifold in fluid communication with each of the plurality of the one or outlet headers;

each of the plurality of tube stacks aligned one above another in a direction perpendicular to a length of the evaporator tubes;

a plurality of flow control devices to dynamically control the flow of a working fluid to a respective inlet header;

a plurality of pressure sensors, each pressure sensor coupled to one of the tube stacks near a center thereof, each pressure sensor in fluid communication with a working fluid carried within the tube stack;

a plurality of temperature sensors, one of the temperature sensors located in each of the outlet headers for monitoring the temperature of a working fluid within the outlet header;

a controller in operative communication with the flow control devices, the pressure sensors and the temperature sensors, the controller being configured to achieve a balanced pressure drop in a working fluid to balance flow distribution between the plurality of tube stacks;

discharging a hot gas from a furnace or boiler through the once-through evaporator;

where a direction of flow of hot gas is perpendicular to a direction of flow of the working fluid; and measuring a parameter of the working fluid with at least one of the temperature and pressure sensors;

changing a rate of discharge of the working fluid through the once-through evaporator if the parameter lies outside a desired value; where the change in the rate of discharge is brought about by one of the flow control devices; and controlling the flow control devices to achieve a balanced pressure drop in the working fluid to balance flow distribution between the plurality of tube stacks.

7. The method of claim 6, further comprising transferring heat from the hot gas to the working fluid.

8. The method of claim 6, where the parameter is pressure, strain, temperature, a phase change, a mass or volumetric flow rate, or a combination thereof.

9. A once-through horizontal evaporator for carrying a working fluid comprising:

a horizontal duct to pass a flow of heated gas;

an inlet manifold;

a plurality of inlet headers in fluid communication with the inlet manifold;

a plurality of tube stacks, where each tube stack comprises one or more substantially horizontal evaporator tubes, each of the tube stacks being vertically stacked one on top of another within the horizontal duct; each of the tube stacks being in fluid communication with one of the plurality of inlet headers;

a plurality of outlet headers, each outlet header being in fluid communication with one of the tube stacks;

an outlet manifold in fluid communication with each of the plurality of outlet headers;

each of the plurality of tube stacks aligned one above another in a direction perpendicular to a length of the evaporator tubes;

a plurality of flow control devices to dynamically control the flow of a working fluid to a respective inlet header;

a plurality of pressure sensors, each pressure sensor coupled to one of the tube stacks near a center thereof, each pressure sensor in fluid communication with a working fluid carried within the tube stack;

a plurality of temperature sensors, one of the temperature sensors located in each of the outlet headers for monitoring the temperature of a working fluid within the outlet header;

a controller in operative communication with the flow control devices, the pressure sensors and the temperature sensors, the controller being configured to achieve a balanced pressure drop in a working fluid to balance flow distribution between the plurality of tube stacks.

10. The once-through horizontal evaporator of claim 9, wherein the evaporator tubes of each of the tube stacks are stacked vertically and are angled in the direction of the flow of heated gas.

11. The once-through horizontal evaporator of claim 9, wherein the evaporator tubes of each tube stack include a serpentine shape with a plurality of horizontal tube portions.

* * * * *